US006151045A

United States Patent [19]

Beach et al.

[11] Patent Number: 6,151,045

[45] Date of Patent: Nov. 21, 2000

[54] SURFACE MODIFIED NOZZLE PLATE

[75] Inventors: Bradley Leonard Beach; Sean David Smith; Tonya Harris Jackson; Jing Xiao Sun, all of Lexington, Ky.

[73] Assignee: Lexmark International, Inc., Lexington, Ky.

[21] Appl. No.: 09/235,578

[22] Filed: Jan. 22, 1999

[51] Int. Cl.[7] ..... B41J 2/135

[52] U.S. Cl. ..... 347/45

[58] Field of Search ..... 347/45, 47

[56] References Cited

U.S. PATENT DOCUMENTS

| | | | |
|---|---|---|---|
| 3,361,589 | 1/1968 | Lindsey . | |
| 4,542,389 | 9/1985 | Allen | 347/44 |
| 5,019,210 | 5/1991 | Chou et al. . | |
| 5,133,840 | 7/1992 | Buchwalter et al. . | |
| 5,136,310 | 8/1992 | Drews | 347/45 |
| 5,212,496 | 5/1993 | Badesha et al. | 347/45 |
| 5,357,005 | 10/1994 | Buchwalter et al. . | |
| 5,415,927 | 5/1995 | Hirayama et al. | 428/307.3 |
| 5,595,785 | 1/1997 | Hindagolla et al. . | |
| 5,598,193 | 1/1997 | Halko et al. . | |
| 5,646,657 | 7/1997 | Aoki | 347/45 |

*Primary Examiner*—John Barlow
*Assistant Examiner*—Michael S. Brooke
*Attorney, Agent, or Firm*—Michael T. Sanderson; Luedeka, Neely & Graham

[57] ABSTRACT

The specification describes a method and composition for treating selected areas of the surface of a polyimide material used to make a nozzle plate for an ink jet printer in order to decrease the surface energy of the polyimide material so ink repellency of the material is increased in the selected areas. The method includes applying a polydialkylsiloxane having reactive end groups to the selected areas of the polyimide material and curing the polydialkylsiloxane on the surface to provide a surface having decreased surface energy. A particularly preferred polydialkylsiloxane is an amine terminated polydialkylsiloxane having a molecular weight ranging from about 500 to about 40,000 number average molecular weight. Because the polydialkylsiloxane is relatively stable at the adhesive curing temperatures used to bond the nozzle plate to a semiconductor chip, the polydialkylsiloxane can be applied prior to curing the adhesive thereby reducing the steps required to provide nozzle plates having decreased ink wettability.

43 Claims, 4 Drawing Sheets

VIEW B–B

SURFACE MODIFIED NOZZLE PLATE

FIELD OF THE INVENTION

The invention relates to ink-jet printers and, in particular, surface modified nozzle plates for printheads which exhibit modified wettability characteristics.

BACKGROUND OF THE INVENTION

Ink jet printer technology continues to improve to provide faster printers which produce higher quality print. In order to achieve these goals, printhead materials, designs and manufacturing procedures continue to change and evolve. In newer printhead designs, the nozzle plates contain smaller, more closely spaced nozzle holes and increased numbers of nozzle holes per nozzle plate. As the size of the nozzle holes decreases and the need for increased production increases, it becomes increasing difficult to provide relatively inexpensive printheads which function to provide quality print over the life of the printhead.

One of the problems which may occur during a printing operation is that ink tends to accumulate on the nozzle plate surface adjacent the nozzle holes. The accumulated ink can, over time, partially block and cause misdirection of ink droplets ejected from the nozzle plate or, in a severe case, totally block ink ejection from the affected nozzle hole. An excess accumulation of ink on the nozzle plate adjacent a nozzle hole during firing of a nozzle is often referred to in the art as "flooding" since the ink may actually accumulate to the point that it covers the nozzle holes. Another accumulation of ink on the nozzle plate is the result of ink pooling. "Pooling" is defined as the accumulation of ink on the nozzle plate when a "tail" of ink forms as the ink droplet is ejected and the ink tail breaks away from the main droplet and deposits back on the nozzle plate. Pooling of ink does not necessarily occur only adjacent the nozzle holes and may occur anywhere on the nozzle plate.

In addition to interfering with ink ejection from a printhead, ink accumulation on a nozzle plate of a multicolor printhead whether from flooding or pooling may result in ink color mixing. As a result of ink color mixing, the ink droplets ejected from affected nozzle holes may not provide the intended color dots thereby reducing print quality. As nozzle holes and their associated ink ejection heaters become smaller and the distance between adjacent nozzle holes is reduced to provide higher quality, faster printing, the effects of ink accumulation or flooding of the nozzle plates becomes a more important factor in the operation of the printer.

Attempts have been made to control nozzle flooding and pooling by applying certain fluorocarbon coatings to the nozzle plates. While such fluorocarbon compounds may possess the desired anti-wetting properties, they generally require the use of an intermediate bridging material capable of bonding the fluorocarbon compound to the nozzle plate material. Use of an intermediate material in addition to the fluorocarbon compound involves additional processing steps which increase the manufacturing cost of the printheads. Furthermore, some of the coating materials presently available often require relatively thick coatings ranging from about 0.3 to about 2 $\mu$m. Despite the relatively thick coating, the coatings are not sufficiently durable and may be readily removed or rendered ineffective by techniques used to clean the printheads long before achieving the expected printhead life. Because the coatings are relatively thick, they may also interfere with the nozzle holes causing printhead operational problems.

In addition to the fluorocarbon coatings, other coatings which have been applied to components of the printhead for various purposes have been observed to result in covering the nozzle holes and thereby interfere with the operation of the printhead. Such coatings are typically applied during one or more steps in the manufacturing process and include adhesives, epoxies, silicones, polyurethanes and the like which are applied to protect electrical components of the printhead from corrosion caused by the ink.

It is therefore an object of the invention to provide an improved printhead for an ink jet printer.

Another object of the invention is to provide a nozzle plate having reduced ink flooding and pooling tendencies.

A further object of the invention is to provide a method for making a nozzle plate for an ink jet printer.

Another object of the invention is to provide a coated nozzle plate which avoids disadvantages of conventionally coated nozzle plates.

Still another object of the invention is to provide a nozzle plate having a substantially durable surface-energy modifying coating.

Another object of the invention is to provide a coating technique for applying a surface-energy modifying coating to selected areas of a nozzle plate.

Another object of the invention is to provide a nozzle plate having an ink repellent coating in a pattern which substantially reduces ink flooding, pooling and ink color mixing.

SUMMARY OF THE INVENTION

With regard to the above and other objects and advantages, the invention provides a nozzle plate for an ink jet printer including a polyimide nozzle plate having an exposed surface wherein at least a portion of the exposed surface contains a coating or layer derived from a polydialkylsiloxane having at least one reactive end group and having a molecular weight ranging from about 500 to about 40,000 number average molecular weight.

In another aspect, the invention provides a method for modifying surface wettability of a polymeric nozzle plate for an ink jet printer. The method includes applying polydialkylsiloxane having at least one reactive end group and having a molecular weight ranging from about 500 to about 40,000 number average molecular weight to at least a portion of an exposed surface of a polyimide nozzle plate, and heating the nozzle plate and polydialkylsiloxane for a period of time under conditions sufficient to provide an exposed surface-energy modifying coating or layer having a thickness ranging from about 500 Ångstroms to less than about 0.1 micron.

An advantage of the coating and method of the invention is that an effective coating may be applied to a nozzle plate which may be cured along with the adhesives used to assemble the nozzle plate to the chip or semiconductor substrate. Furthermore, the polydialkylsiloxane is sufficiently reactive with the nozzle plate material at the adhesive curing temperatures to form a durable bond therewith without the need for an intermediate coating between the polydialkylsiloxane and the nozzle plate. Additionally, only a relatively small amount of polydialkylsiloxane is required to achieve a desirable reduction in surface-energy properties of the nozzle. This results in a significantly reduced coating thickness as compared to prior coatings, thus avoiding problems associated with relatively thick coatings.

The polydialkylsiloxane coating may be readily applied to a nozzle plate material by a variety of coating techniques.

Selective application of the surface-energy modification material to portions of the nozzle plate adjacent the nozzle holes may be used to direct ink to ink recovery areas of the nozzle plate, to prevent ink color mixing between different color inks or to prevent flow of coating or adhesive materials over the nozzle holes during one or more printhead manufacturing steps.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figure 1A:
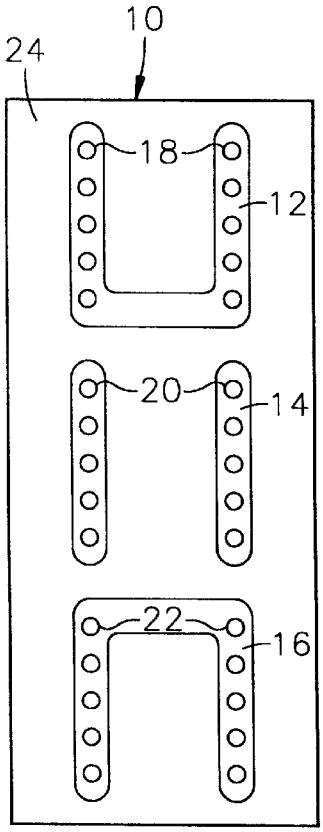
FIGS. 1A, 1B and 1C are plan top views of nozzle plates containing a surface-energy modifying coating according to the invention.

In a preferred embodiment of the invention, a nozzle plate for an ink jet printer is provided which includes a surface-energy modifying compound on at least a portion of one exposed surface of the nozzle plate. For modern ink jet printers, the nozzle plates are typically polymeric materials, most preferably polyimide. Polyimide is relatively hydrophobic and has an untreated surface-energy of about 45 dynes. However, for ink jet printing applications, a lower surface-energy, preferably lower than about 40 dynes and most preferably lower than about 30 dynes is desirable in order to reduce flooding and flow of coating materials over the nozzle holes.

In order to lower the surface-energy of the polyimide nozzle plate, the exposed surface of the polyimide may be treated or coated with a suitable material to provide a layer having the desired wettability properties. Because polyimide is relatively inert to chemical attack, coating materials have been widely used to reduce the surface-energy of the nozzle plates. However, coatings typically must be reapplied periodically and are often not durable enough to last for the life of the printhead.

As an alternative to simply coating the polyimide nozzle plate, the polyimide may be reacted with or etched under certain conditions to provide reactive sites for chemical modification of the surface properties thereof. For example, the polyimide may be exposed to a strong base such as potassium hydroxide or sodium hydroxide for a sufficient period of time at an elevated temperature, and then rinsed and neutralized with a dilute acid. As a result of this treatment, carboxyl groups are formed at the surface of the polyimide. The carboxyl groups may be reacted with epoxies, hydrazines, alcohols and the like as described more fully in U.S. Pat. No. 5,133,840 to Buchwalter et al., the entire disclosure of which is incorporated by reference as if fully set forth herein.

A particularly preferred method for lowering the surface-energy of the polyimide nozzle plate is to contact the surface with a polymeric compound having at least one terminal group which is reactive with the polyimide and then causing the end group to react with the polyimide under conditions sufficient to form a relatively strong chemical bond between the polyimide and the end group of the polymer. For polyimide nozzle plate materials, the end group of the polymer is preferably a basic end group, most preferably an amine end group which is basic enough at an elevated temperature to open the imide ring of the polyimide to form an amide bond therewith. Accordingly, it is preferred to react the polyimide nozzle plate with an amine terminated polysiloxane, more preferably an aminoalkyl terminated polydialkylsiloxane and most preferably an aminopropyl terminated polydimethylsiloxane (ATPDMS) of the formula

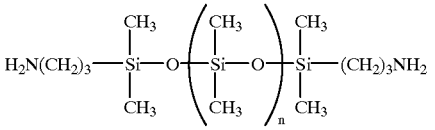

wherein n is an integer ranging from about 100 to about 500. A particularly preferred siloxane compound of the foregoing formula has a number average molecular weight ranging from about 500 to about 40,000, and is available from Gelest, Inc. of Tullytown, Pa. under the trade designation DMS-A32.

In order to modify the surface-energy of the polyimide nozzle plate using the ATPDMS as described above, at least a portion of the surface of the nozzle plate is contacted with the ATPDMS and heated under conditions sufficient to cause reaction between the amine end group of the ATPDMS and the polyimide. Reaction conditions are selected which provide sufficient reaction but are not severe enough to affect the other components of the printhead structure. Ideally, the ATPDMS is reacted at the adhesive cure temperature used to bond the nozzle plate to a semiconductor chip. A preferred temperature for causing reaction between the ATPDMS and the polyimide is from about 135° to about 200° C., most preferably from about 140° to about 190° C. While the reaction between the ATPDMS and polyimide is relatively rapid at elevated temperatures, in order to completely cure the adhesive at the same time, it is preferred to maintain the temperature for at least about 20 minutes, preferably from about 30 to about 50 minutes or more.

Because of its relatively high molecular weight, a relatively thin layer of the APDMS provides a substantial decrease in the surface-energy of the polyimide. Whereas the untreated polyimide may have a surface-energy of about 45 dynes, treatment of the surface of the polyimide under the conditions described herein has been found to lower the surface-energy to less than about 30 dynes, preferably less than about 25 dynes and most preferably to a range of from about 15 to about 20 dynes. Without being bound by theoretical considerations, it is believed that ATPDMS reacted under the conditions described above forms a monolayer of polydimethylsiloxane (PDMS) on the surface of the polyimide which is covalently bound to the polyimide through an amide linkage. After curing, the coating thickness may range from about 500 Ångstroms to less than about 0.1 micron in total thickness, and has been observed to be durable for the use of print head applications.

A polyimide material which may be used as a nozzle includes materials available from DuPont Corporation of Wilmington, Del. under the trade name PYRALUX and from Rogers Corporation of Chandler, Ariz. under the trade name R-FLEX 1100. It is particularly preferred to use a polyimide material which contains an adhesive layer on one surface for attaching the polyimide nozzle plate to a semiconductor chip. Prior to attaching the polyimide to the chip, the flow features including the nozzle holes and ink chambers are formed in the polyimide using laser ablation techniques. Once the flow features and nozzles are formed, the nozzle plate is tacked to the semiconductor chip using heat and pressure. Prior to curing the adhesive between the polyimide and the chip, the ATPDMS is applied to the exposed surface of the nozzle plate in the desired locations.

It is not necessary or desirable to coat the entire nozzle plate surface with a surface-energy modifying compound. Selective application of the ATPDMS to one or more portions of the surface of the nozzle plate has been observed to suitable reduce the surface-energy of the nozzle plate in selected areas of the nozzle plate.

Figure 1B:
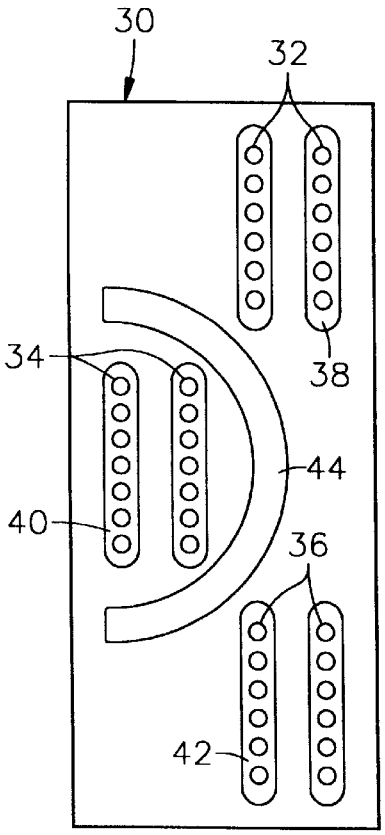
Figure 1C:
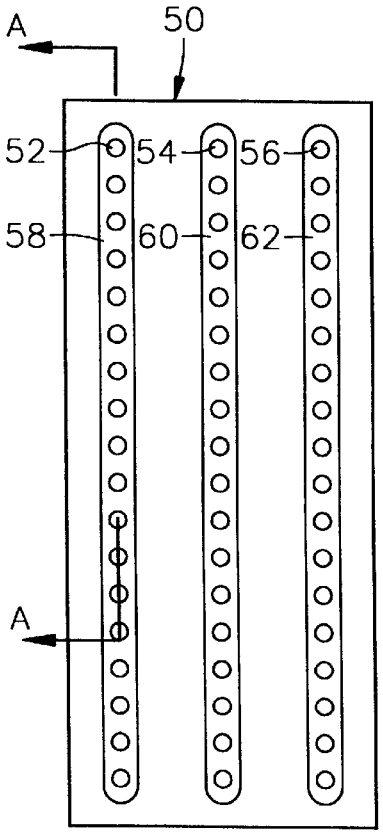

By way of example, FIGS. 1A–1C illustrate coating designs which provide desirable wettable and non-wettable nozzle plate surfaces. FIG. 1A is a plan view from the exposed surface of a nozzle plate 10 containing coated areas 12, 14 and 16 which are adjacent nozzle hole arrays 18, 20 and 22, respectively. Nozzle hole arrays 18, 20 and 22 may be used for multicolor application of ink to a print media with each array being a separate color or the arrays may be used together to apply a single color ink to a print media. Regardless of whether the nozzle plate is used for a single color printing or multi-color color printing, only the areas immediately adjacent the nozzle hole arrays 18, 20 and 22 contain a monolayer of PDMS while more remote areas such as areas 24 are not treated with the ATPDMS.

FIG. 1B illustrates another nozzle hole array design for a single or multi-color ink jet printer nozzle plate 30 according to the invention. Each of the nozzle hole arrays 32, 34 and 36 is surrounded by the PDMS coatings 38, 40 and 42 respectively in order to provide a surface-energy adjacent the nozzle hole arrays which is lower than the surface-energy of the untreated areas. An additional coated area 44 remote from adjacent the nozzle hole arrays may be provided to further isolate nozzle hole arrays 32 and 36 from array 34 for improved printhead operation.

Yet another treated nozzle plate 50 is shown in FIG. 1C. The plate 50 includes nozzle arrays 52, 54 and 56. As with the previous nozzle plate designs, each of the nozzle hole arrays may be used to apply a single color or a different color ink to a print media. Each of the arrays 52–56 is surrounded by a treated area, 58, 60 and 62 respectively which effectively reduces the surface-energy of the nozzle plate in the areas surrounding or adjacent the nozzle holes.

In each of the foregoing nozzle plate designs, the annular treated area around the nozzle holes preferably ranges from about 5 to about 100 $\mu$m wide. A preferred annular treated area immediately adjacent each nozzle hole is about 50 $\mu$m wide. In FIG. 1B, the annular width of the treated area 44 is about 50 to about 300 $\mu$m wide.

Figure 2:
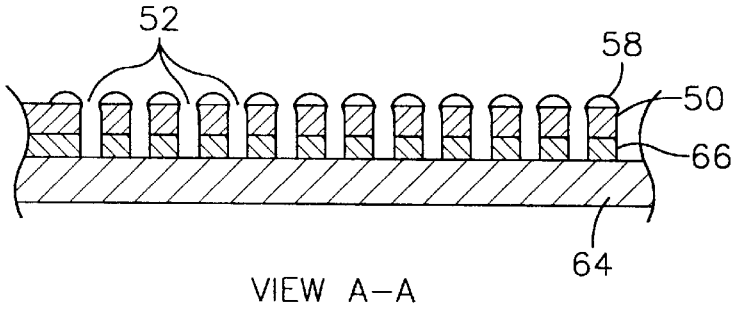
FIG. 2 is a cross-sectional view, not to scale of a portion of a nozzle plate containing a surface-energy modifying coating according to the invention.

FIG. 2 is a partial cross sectional view through the nozzle plate 50 and silicon substrate 64 along line A—A of FIG. 1C which shows the relationship of the treated area 58 to the nozzle hole array 52. As described previously, the nozzle plate 50 is preferably attached to the silicon substrate 64 using adhesive 66.

Figure 3:
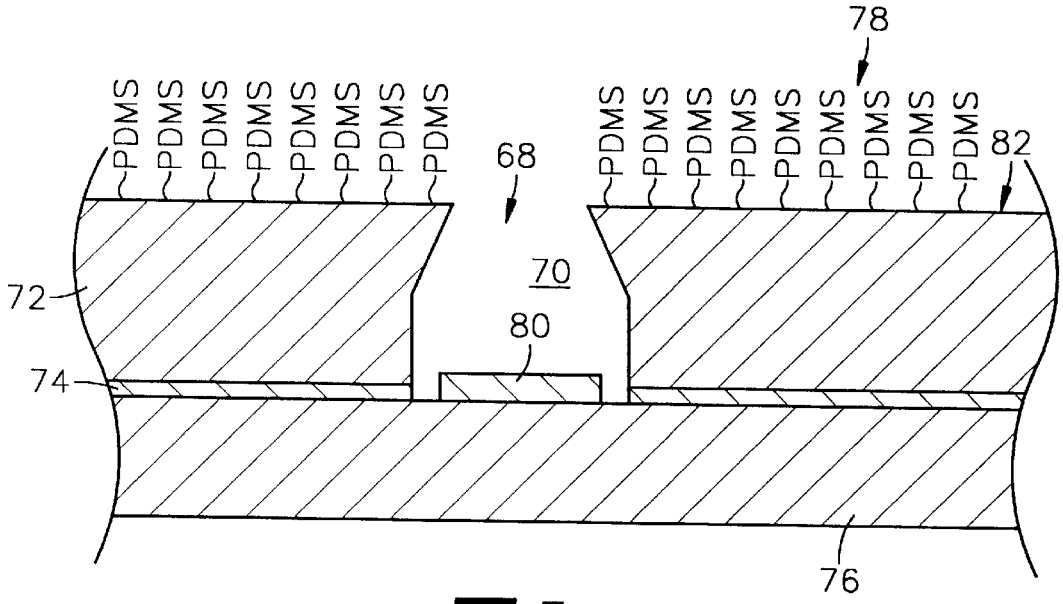
FIG. 3 is an enlarged cross-sectional view through one nozzle hole of a nozzle plate containing a coating according to the invention.

FIG. 3 is an enlarged cross-sectional view, not to scale of one nozzle hole 68 of the nozzle hole array 52 of FIG. 1C. The nozzle hole 68 and ink chamber 70 are formed in the polyimide material 72 and adhesive layer 74 as by laser ablating the polyimide. The adhesive layer 74 is preferably a B-stageable thermal cure resin, including but not limited to, phenolic resins, resorcinol resins, epoxy resins, ethylene-urea resins, furane resins, polyurethane resins, silicone resins and the like, which are used to fixedly attach the polyimide material 72 to a silicon substrate 76. A monolayer 78 of ATPDMS is applied and cured so that PDMS is covalently bound to the substrate by reaction between a terminal aminopropyl group of the ATPDMS and the polyimide material. The treated area containing monolayer 78 effectively repels ink ejected through nozzle hole 68 by means of heater 80 so that it doesn't accumulate on the surface 82 of the polyimide 72 in the area immediately adjacent the nozzle hole 68. Because the PDMS is bound to the polyimide surface 82, the treated area is essentially durable and resists removal during printhead cleaning operations. The ATPDMS treatment has been demonstrated to remain effective after more than about 500 to about 5000 printhead cleaning cycles.

With respect to determining the flooding or pooling potential of a nozzle plate or nozzle plate coating, a subjective scale of 0 to 7 is used with 0 being no flooding or pooling and 7 being significant accumulation of ink on the nozzle plate. In order to observe nozzle plate flooding characteristics, a lighted microscope is used to observe the ink accumulation around the nozzle holes during firing of the nozzles into space. The pooling potential of a nozzle plate or coating is also observed with the use a lighted microscope after terminating the operation of the printhead. In the case of pooling, the printhead is used to print images on a print media during the printhead operation. Untreated nozzle plates have flooding rates of 4–5 whereas the flooding rate of the polyimide nozzle plate treated with ATPDMS according to the invention is about 0 to about 1.

The ATPDMS may be applied to the exposed surface of the nozzle plate by a variety of techniques including spraying, dipping, spin coating, brushing, and the like. In a preferred technique, a silicon rubber pad or roller is impregnated with ATPDMS and the pad or roller is contacted with the exposed surface of the nozzle plate in order to transfer a layer of ATPDMS to the nozzle plate surface. Contact pressure which may be required to transfer a sufficient amount of the ATPDMS to the nozzle plate may range from about 10 pounds per square inch to less than about 100 pounds per square inch.

Figure 4:
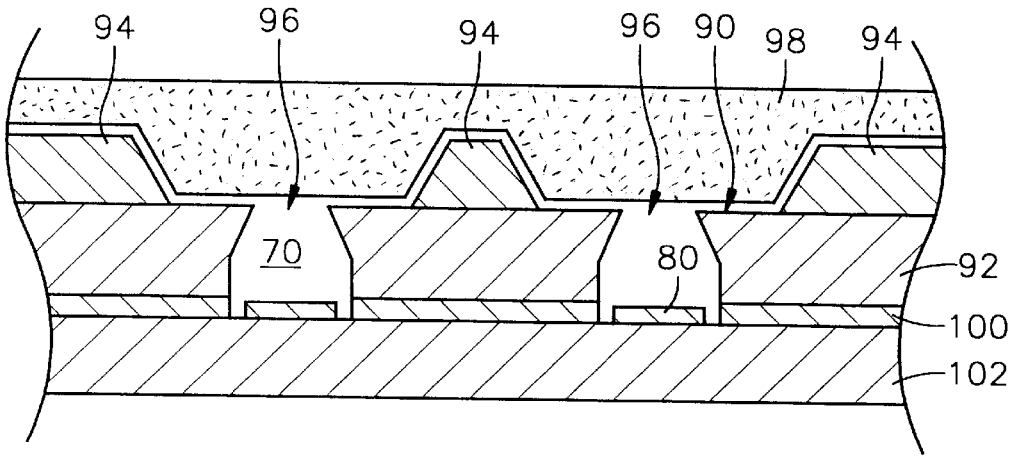
FIG. 4 is an enlarged cross-sectional view of one method for applying a surface-energy modifying coating according to the invention.

FIG. 4 shows a preferred method for applying the ATPDMS to the surface 90 of a polyimide nozzle plate 92. In order to selectively apply the ATPDMS to the surface 90, a mask 94 containing apertures or openings of the desired coating design as described with reference to FIGS. 1A–1C is aligned with the nozzle holes 96 adjacent the surface 90 of the nozzle plate 92. Next a silicon rubber roller or pad 98 impregnated with ATPDMS is pressed against the mask 94 so that selected portions of the roller or pad 98 deposit a thin coating of ATPDMS on the surface 90 of the nozzle plate 92 through the openings or apertures in the mask 94. The coating thickness of the ATPDMS ranges from about 500 Å to about 0.1 $\mu$m. Several applications or pressing of the pad or roller 98 to the mask 94 and nozzle plate 92 may be required to provide a uniform application of the ATPDMS to the surface 90. Because the layer of ATPDMS applied to the nozzle plate 92 is relatively thin, the coating does not interfere with the ejection of ink from nozzle holes 96.

After applying the coating to the selected areas of the nozzle plate, a curing cycle for adhesive 100 to bond the nozzle plate 92 to the silicon chip 102 is conducted. As described above, the curing cycle for adhesive 100 is preferably accomplished at a temperature in the range of from about 150° to about 200° C. for a period of time ranging from about 20 to about 50 minutes or more. This curing cycle is believed to cause a reaction between the ATPDMS so that a monolayer of PDMS forms on the surface 90 of the nozzle plate 92. The normal wiping of the printhead during a printing operation removes any excess or unreacted ATPDMS from the surface 90 of the nozzle plate. Accordingly, a cleaning step after curing the nozzle plate adhesive is generally not necessary to obtain the treated nozzle plates according to the invention.

Figure 5:
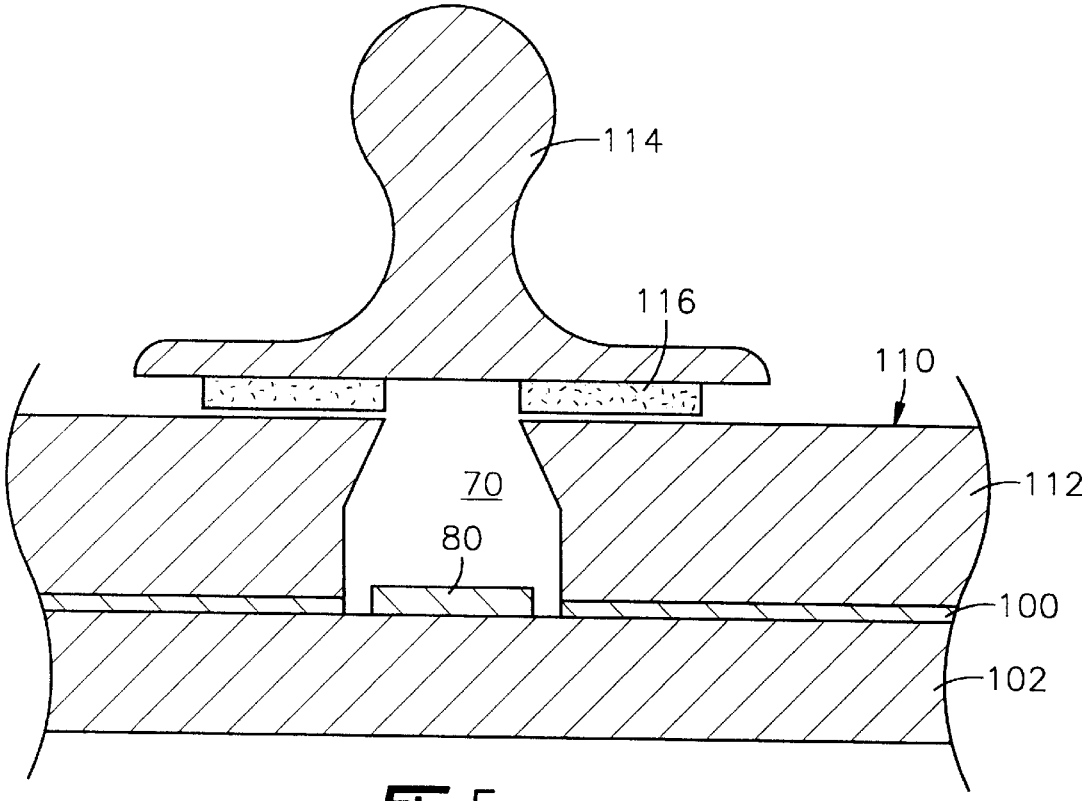
FIG. 5 is an enlarged cross-sectional view of another method for applying a surface-energy modifying coating according to the invention.

FIG. 5 illustrates another method for applying the ATPDMS to selected areas of a surface 110 of a nozzle plate 112. According to this method, a pad or roller 114 having impregnated silicon rubber application pads 116 of the desired coating design is pressed to the surface 110 of the nozzle plate 112 in the absence of a mask. Only the impregnated pads 116 contact the nozzle plate transferring an ATPDMS coating to the nozzle plate surface 110 in accordance with the pad design. Curing of the adhesive 100 and bonding of the coating to the nozzle plate proceeds as described above with reference to FIG. 4.

Because the surface-energy modifying coating is only applied to selected areas of the nozzle plates, ink will tend to accumulate in the untreated areas of the nozzle plates. In order to remove ink from the untreated areas, these areas of the nozzle plate may contain channels or ink drain holes to return the ink to the ink supply or to an ink containment structure. The drain holes may be located between the nozzle holes above the ink via region or ink feed region on the semiconductor chip or between the nozzle holes and electrical contact pads adjacent the edge of the semiconductor chip. A wiper may be used in combination with the drain holes to remove excess ink in the area of the drain holes. One method for removing ink from the accumulated areas is described in U.S. Pat. No. 4,542,389 to Allen, incorporated herein by reference as if fully set forth.

Figure 6:
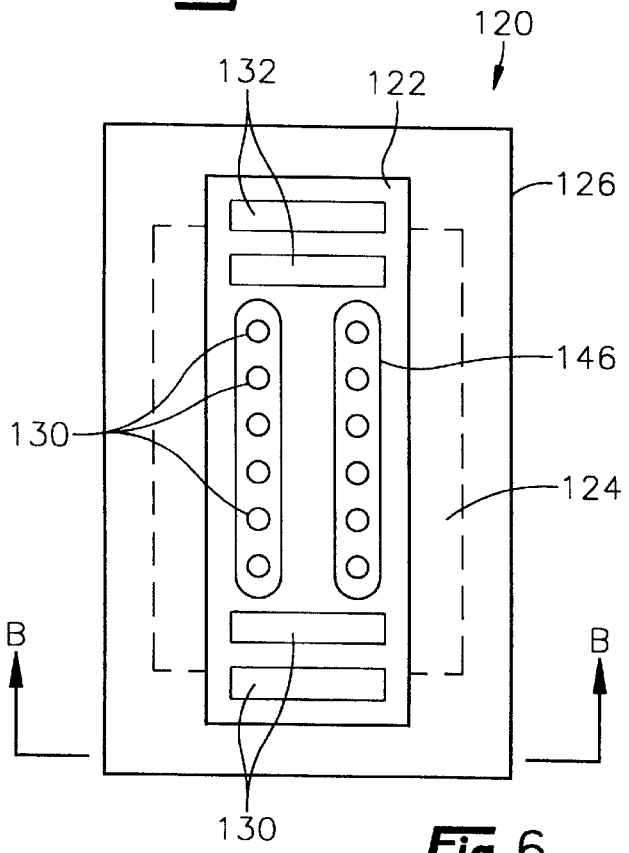
FIG. 6 is a top plan view of a nozzle plate attached to a silicon substrate and a flex circuit showing selected surface-energy modified areas on the nozzle plate surface.
Figure 7:
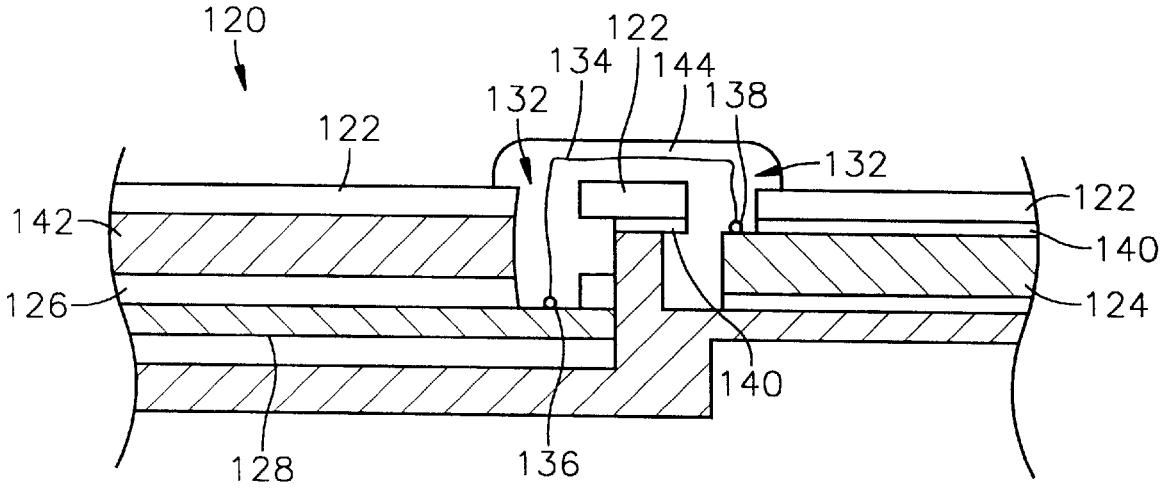
FIG. 7 is an enlarged cross-sectional view through a portion of the printhead assembly of FIG. 6.

While ATPDMS is particularly useful for modifying the surface-energy of the nozzle plate to prevent ink flooding during printing operations, it may also provide a surface-energy modification useful in other printhead assembly steps. For example, FIGS. 6 and 7 illustrate a printhead 120 for an ink jet printer which includes a nozzle plate 122 attached to a semiconductor silicon chip 124 and a TAB circuit, flex circuit or printed circuit board 126 containing electrical traces 128 for electrically connecting ink energizing elements on the chip 124 to a printer for selective ejection of ink from nozzle holes 130.

Electrical connections are typically made by attaching wires or traces 134 from contact pads 136 on the electrical traces 128 to contact pads 138 on the silicon chip 124 through openings or windows 132 in the nozzle plate 122, adhesive layers 140 and 142 and flex circuit material 126. Once the electrical connections are completed, an elastomeric encapsulate material 144 is applied adjacent windows 132 to protect the wires 134 and connections to the contact pads 136 and 138. The layer of elastomeric material is preferably no thicker than about 10 mils. Suitable encapsulate materials include silicon polymer coatings having a coefficient of thermal expansion greater than or equal to that of the wire 134 as well as silicone, polyurethane, and urethane acrylate coatings.

During the application of the encapsulate material 144, there is a tendency for the material to flow or run toward the nozzle holes 130, particularly the nozzle holes 130 closest to windows 132. Accordingly, in order to reduce the tendency for the encapsulate material to flow toward nozzle holes, areas of low surface-energy 146 are provided around the nozzle holes 130. The low surface-energy areas 146 are provided according to the methods described above by applying the ATPDMS to the selected areas of the nozzle plate 122.

In order to increase the surface-energy of the other surface areas of the nozzle plate for purposes of aiding fabrication or to improve the ink accumulation in areas other than the ATPDMS treated areas, a high surface-energy coating may be applied to the nozzle plate after curing the low surface-energy coating. Suitable high surface-energy coatings include amine terminated polar compounds such as 3-amino-1,2-propanediol, 2-amino-5-nitrobenzene-sulfonic acid, aminopropylsulfonic acid sodium salt, sodium salt dihydrate and other amine terminated organic compounds such as, but not limited to alcohols, carboxylic acids and salt hydrates. These compounds may be applied using masking techniques or pads or rollers having the desired coating design, or by spraying, spin coating, dipping, or brushing the compound onto the surface of the nozzle plate after curing the low surface-energy coating. Because of the presence of the low surface-energy coating, the high surface-energy coating will only adhere to those areas of the nozzle plate which do not contain the PDMS material.

In a preferred embodiment, a 2 wt. % aminopropylsulfonic acid sodium salt in gamma butyrol lactone and 5.6 wt. % water is spin coated onto the nozzle plate assembly after curing the adhesive and treating the nozzle plate with ATPDMS. The solution may be spun coated onto the assembly at about 1500 rpm for 2 minutes after presoaking the assembly with the solution for about 30 seconds. The coated nozzle plate is then cured at a temperature of from about 130° to about 155° C. for about 90 minutes or more. Excess and/or unreacted compound may be removed from the assembly by washing the assembly with deionized water.

Having now described the invention and preferred embodiments thereof, it will be recognized by those of ordinary skill that the invention is capable of numerous modifications, rearrangements and substitutions without departing from the spirit and scope of the invention as defined by the appended claims.

What is claimed is:

1. A nozzle plate for an ink jet printer comprising a polyimide nozzle plate having an exposed surface, at least a portion of the exposed surface containing a layer derived from a polydialkylsiloxane having at least one reactive end group and having a molecular weight ranging from about 500 to about 40,000 number average molecular weight, wherein the polydialkylsiloxane is covalently bound to the exposed surface of the polyimide nozzle plate by means of the reactive end group.

2. The nozzle plate of claim 1 wherein the layer comprises a monolayer of polydialkylsiloxane bound by means of a terminal amine group to the exposed surface of the polyimide.

3. The nozzle plate of claim 2 wherein the monolayer has a thickness ranging from about 5 Ångstroms to less than about 0.1 micron.

4. The nozzle plate of claim 1 wherein the layer is derived from a compound of the formula

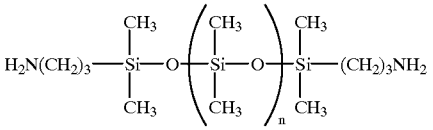

wherein n is an integer ranging from about 100 to about 500.

5. The nozzle plate of claim 1 wherein the layer is derived from aminopropyl terminated polydimethylsiloxane having a number average molecular weight ranging from about 800 to about 30,000.

6. The nozzle plate of claim 1 wherein the layer is applied adjacent the nozzle holes to provide an annular treated area around the nozzle holes wherein the annular treated area ranges from about 5 to about 100 microns in width.

7. The nozzle plate of claim 1 comprising at least two discrete nozzle arrays and a treated area containing the layer around each of the nozzle arrays.

8. The nozzle plate of claim 1 comprising at least three discrete nozzle arrays, a treated area containing the layer around each of the nozzle arrays, and a treated area containing the layer between the nozzle arrays.

9. The nozzle plate of claim 1 further comprising a second portion containing a layer having increased surface-energy.

10. A method for modifying surface wettability of a polymeric nozzle plate for an ink jet printer which comprises applying polydialkylsiloxane having at least one reactive end group and having a number average molecular weight ranging from about 500 to about 40,000 to at least a portion of an exposed surface of a polyimide nozzle plate, and heating the nozzle plate and polydialkylsiloxane for a period of time under conditions sufficient to provide an exposed surface-energy modifying layer having a thickness ranging from about 500 Ångstroms to less than about 0.1 micron, wherein the polydialkylsiloxane is covalently bound by means of the reactive end group to the polyimide nozzle plate.

11. The method of claim 10 wherein the layer is derived from a compound of the formula

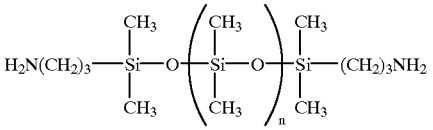

wherein n is an integer ranging from about 100 to about 500.

12. The method of claim 10 wherein the layer is derived from aminopropyl terminated polydimethylsiloxane.

13. The method of claim 10 wherein the polydialkylsiloxane is applied to the nozzle plate adjacent the nozzle holes so that an annular area around each nozzle hole having modified surface wettability ranges from about 5 to about 100 microns in width.

14. The method of claim 10 wherein the nozzle plate comprises at least two discrete nozzle arrays and the polydialkylsiloxane is applied to the nozzle plate adjacent the nozzle holes of each of the nozzle arrays.

15. The method of claim 10 wherein the nozzle plate comprises at least three discrete nozzle arrays, and the polydialkylsiloxane is applied to the nozzle plate in an area around each of the nozzle arrays, and in an area between the nozzle arrays.

16. The method of claim 10 further comprising applying a coating or layer to a second portion of the exposed surface of the nozzle plate to provide an area of increased surface-energy.

17. A nozzle plate for an ink jet printhead consisting essentially of a polyimide substrate and a patterned monolayer comprising a derivative of polydialkylsiloxane having at least one reactive end group for forming a covalent bond with the polyimide substrate and having a molecular weight ranging from about 500 to about 40,000 number average molecular weight, the polydialkylsiloxane being covalently bound by means of the reactive end group to the polyimide substrate.

18. The nozzle plate of claim 17 wherein the monolayer has a thickness ranging from about 5 Ångstroms to less than about 0.1 micron.

19. The nozzle plate of claim 17 wherein the monolayer is derived from a compound of the formula

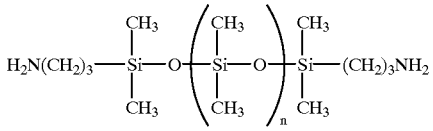

wherein n is an integer ranging from about 100 to about 500.

20. The nozzle plate of claim 17 wherein the monolayer is derived from aminopropyl terminated polydimethylsiloxane having a number average molecular weight ranging from about 800 to about 30,000.

21. The nozzle plate of claim 17 wherein the monolayer is applied adjacent nozzle holes on the nozzle plate so that an annular treated area around each nozzle hole ranges from about 5 to about 100 microns in width.

22. The nozzle plate of claim 17 comprising at least two discrete nozzle arrays and a treated area containing the monolayer around each of the nozzle arrays.

23. The nozzle plate of claim 17 comprising at least three discrete nozzle arrays, a treated area containing the monolayer around each of the nozzle arrays, and a treated area containing the monolayer between the nozzle arrays.

24. A method for making a printhead for a multi-color ink jet printer which comprises laser ablating a polymeric material to form nozzle holes therein, applying polydialkylsiloxane to less than an entire exposed surface of the polymeric material, the polydialkylsiloxane having at least one reactive end group for forming a covalent bond with the polymeric material, attaching the thus treated polymeric material to a silicon substrate with an adhesive and curing the adhesive at a temperature sufficient to form the covalent bond between the polydialkalsiloxane and the polymeric material.

25. The method of claim 24 wherein the polydialkylsiloxane is derived from a compound of the formula:

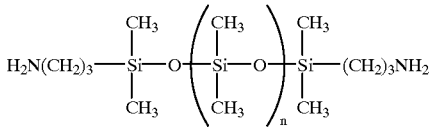

wherein n is an integer ranging from about 100 to about 500.

26. The method of claim 24 wherein the polydialkylsiloxane is derived from aminopropyl terminated polydimethylsiloxane.

27. The method of claim 24 wherein the polydialkylsiloxane is applied to the polymeric material adjacent the nozzle holes so that an annular area around each nozzle hole having a modified surface wettability ranges from about 5 to about 100 microns in width.

28. The method of claim 24 wherein the polymeric material is treated to provide at least two discrete nozzle arrays thereon and the polydialkylsiloxane is applied to the polymeric material adjacent nozzle holes associated with each of the nozzle arrays.

29. The method of claim 24 wherein the polymeric material comprises at least three discrete nozzle arrays, and the polydialkylsiloxane is applied to the polymeric material in an area around each of the nozzle arrays, and in an area between the nozzle arrays.

30. The method of claim 24 further comprising applying a coating or layer having increased surface-energy to an exposed surface portion of the polymeric material separate from the portion containing the polydialkylsiloxane.

31. A method for treating selected portions of a polyimide surface to render a first portion substantially repellent to ink and to render a second portion substantially hydrophilic, the method comprising the steps of:

applying a first material to selected first portions of an exposed surface of the polyimide surface;

curing the applied coating material to provide ink repellency to the selected portions of the exposed surface; and applying a second coating having increased surface-energy to selected second portions of the polyimide surface;

wherein the first coating material comprises polydialkylsiloxane having at least one end group which is reactive with polyimide and having a number average molecular weight ranging from about 500 to about 40,000 and having a thickness of less than about 0.1 micron, the polydialkylsiloxane being covalently bound to the polyimide by means of the reactive end group.

32. The method of claim 31 wherein the first material is derived from a compound of the formula

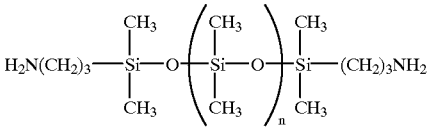

wherein n is an integer ranging from about 100 to about 500.

33. The method of claim 31 wherein the first material is derived from aminopropyl terminated polydimethylsiloxane.

34. The method of claim 31 wherein the polyimide material contains nozzle holes and the selected first portions are annular areas adjacent the nozzle holes having a width of from about 5 to about 100 microns wide.

35. The method of claim 31 wherein the polyimide material comprises at least two discrete nozzle arrays and the first material is applied to the polyimide material adjacent the nozzle holes of each of the nozzle arrays.

36. The method of claim 31 wherein the polyimide material comprises at least three discrete nozzle arrays, and the first material is applied to the polyimide material in an area around each of the nozzle arrays, and in an area between the nozzle arrays.

37. A polymeric nozzle plate having a first surface attached to a semiconductor substrate containing energizing elements, a second surface opposite the first surface and nozzles holes therethrough from the first surface to the second surface for ejection of ink through the nozzle holes to a print media, the nozzle plate comprising a polyimide material which includes one or more areas adjacent the nozzle holes on the second surface thereof containing an ink repellent amount of a polydialkylsiloxane derived from a polydialkylsiloxane having at lease one reactive end group and having a number average molecular weight ranging from about 500 to about 40,000, wherein the polydialkylsiloxane is bound to the second surface of the polymeric nozzle plate by means of the reactive end group.

38. The nozzle plate of claim 37 wherein the ink repellent amount has a thickness ranging from about 5 Ångstroms to less than about 0.1 micron.

39. The nozzle plate of claim 37 wherein polydialkylsiloxane is derived from a compound of the formula

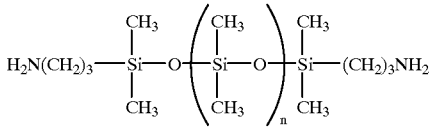

wherein n is an integer ranging from about 100 to about 500.

40. The nozzle plate of claim 37 wherein the polydialkylsiloxane is derived from aminopropyl terminated polydimethylsiloxane having a number average molecular weight ranging from about 800 to about 30,000.

41. The nozzle plate of claim 37 wherein the polydialkylsiloxane is applied adjacent the nozzle holes so that an annular area adjacent the nozzle holes containing the polydialkylsiloxane ranges from about 5 to about 100 microns in width.

42. The nozzle plate of claim 37 comprising at least two discrete nozzle arrays and a treated area containing the polydialkylsiloxane adjacent each of the nozzle arrays.

43. The nozzle plate of claim 37 comprising at least three discrete nozzle arrays, a treated area containing the polydialkylsiloxane adjacent each of the nozzle arrays, and a treated area containing polydialkylsiloxane between the nozzle arrays.

* * * * *